US007894764B2

(12) United States Patent
Yamauchi et al.

(10) Patent No.: US 7,894,764 B2
(45) Date of Patent: Feb. 22, 2011

(54) IMAGE FORMING APPARATUS

(75) Inventors: Kazumichi Yamauchi, Hachioji (JP); Satoshi Sakata, Hino (JP); Kenji Yamamoto, Hachioji (JP); Akira Okamoto, Hino (JP); Kazutoshi Yoshimura, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 951 days.

(21) Appl. No.: 11/798,718

(22) Filed: May 16, 2007

(65) Prior Publication Data

US 2007/0297821 A1 Dec. 27, 2007

(30) Foreign Application Priority Data

Jun. 22, 2006 (JP) ..... 2006-172451

(51) Int. Cl.
*G03G 15/00* (2006.01)
*G03G 21/00* (2006.01)

(52) U.S. Cl. ..... 399/394; 399/16; 399/381; 399/395; 347/104; 271/226

(58) Field of Classification Search ..... 399/9, 399/16, 23, 361, 363, 381, 388, 394–396, 399/411; 347/104–106; 271/226–255
See application file for complete search history.

(56) References Cited

U.S. PATENT DOCUMENTS 5,541,713 A * 7/1996 Takatsuki et al. ..... 399/376
5,676,477 A * 10/1997 Tanaka et al. ..... 400/579
5,823,692 A * 10/1998 Tolrud et al. ..... 400/582
6,342,909 B1 * 1/2002 Joichi et al. ..... 347/129
6,539,199 B1 * 3/2003 Miyata et al. ..... 399/394
6,788,323 B2 * 9/2004 Enomoto et al. ..... 347/177
7,084,418 B2 * 8/2006 Luxem et al. ..... 250/559.4
7,533,959 B2 * 5/2009 Ouchi et al. ..... 347/37
2003/0183356 A1 * 10/2003 Satoh et al. ..... 162/263
2006/0221108 A1 * 10/2006 Morisaki ..... 347/14

FOREIGN PATENT DOCUMENTS

JP 04353876 A * 12/1992
JP 06100203 A * 4/1994

(Continued)

OTHER PUBLICATIONS

Machine translation of JP 2005060007 A, Japan Patent Office, Jun. 8, 2010.*

*Primary Examiner*—Judy Nguyen
*Assistant Examiner*—'Wyn' Q Ha
(74) *Attorney, Agent, or Firm*—Finnegan, Henderson, Farabow, Garrett & Dunner, L.L.P.

(57) ABSTRACT

An image forming apparatus, which includes: an image forming section to form an image on a transfer sheet conveyed to the image forming section; an edge detecting sensor which detects an edge position of the transfer sheet in a main scanning direction while the transfer sheet is conveyed to the image forming section; and a controller which controls an image writing position at the image forming section based on a result of an edge position detection by the edge detecting sensor; wherein the edge detecting sensor comprises a plurality of light sources each having a different wavelength, and the controller comprises a light source controller which controls lighting of the plural light sources.

15 Claims, 10 Drawing Sheets

FOREIGN PATENT DOCUMENTS

| | | | | |
|---|---|---|---|---|
| JP | 2000-335010 | | | 12/2000 |
| JP | 2002154228 | A | * | 5/2002 |
| JP | 2003-223088 | | | 8/2003 |
| JP | 2004058653 | A | * | 2/2004 |
| JP | 2005060007 | A | * | 3/2005 |

* cited by examiner

IMAGE FORMING APPARATUS

BACKGROUND OF THE INVENTION

1. Technical Field

The present invention relates to an image forming apparatus such as a copying machine, a facsimile machine and a multifunctional machine, and in particular, to an image forming apparatus capable of forming an appropriate image in accordance with a position of a transfer sheet in the main scanning direction.

2. Description of Related Art

In the image forming apparatus, printing is carried out in the way wherein an image is formed on a photosensitive drum in an image forming section based on image data obtained through reading with an original reading device, and the image is transferred onto a transfer sheet which has been conveyed from a sheet supply section, and is further fixed.

In the aforesaid printing, if the transfer sheet is conveyed at the same position constantly, the same image can be formed in the transfer sheet, in the image forming section. However, there are some cases where some slight positional slips of the transfer sheet are generated by various types of slips and skews of the transfer sheet generated in the conveyance path from the sheet supply section to the photosensitive drum. When the slips and skews of the sheet of this kind are generated, positional adjustment of the sheet in the conveyance direction (sub-scanning direction) can be carried out by the registration roller immediately before the transfer. However, for sheet slips and sheet skews in the direction perpendicular to the conveyance direction, namely, in the main scanning direction, it is necessary to detect positional slips and thereby to change a scanning position in the image forming section, because the positional adjustment is difficult.

To comply with the aforesaid requirements, a sensor to detect an edge position of the transfer sheet has been provided to detect the edge position of the transfer sheet in transit, and a position of writing on the photosensitive drum in the image forming section has been corrected based on the results of the detection, for appropriated image forming, as disclosed in, for example, Unexamined Japanese Patent Application Publication No. 2000-335010, and Unexamined Japanese Patent Application Publication No. 2003-223088.

A partial structure of the image forming apparatus, which makes the aforesaid correction of the writing position possible, will be explained based on FIGS. 11(*a*)-11(*b*).

Leading edge detecting sensor 190 is provided at the downstream side of registration roller 185 provided on a conveyance path for transfer sheet 100, and edge detecting sensor 220 that is composed of a close contact type line sensor in the direction perpendicular to the conveyance direction is arranged between the leading edge detecting sensor 190 and the registration roller 185. The edge detecting sensor 220 is provided with light-emitting section 220*a* composed of a light source for a single color (preferably, a red light source having excellent reactivity), light guide member 221 that receives light coming from the light-emitting section 220*a* and emits light to the transfer sheet, and with light-receiving section 220*b* that receives reflected light coming from transfer sheet 100 or from conveyance guide plate 186 positioned outside the transfer sheet.

While emitting light from the light-emitting section 220*a* corresponding to an operation of registration roller 185, after leading edge detection of transfer sheet by the leading edge detecting sensor 190, the edge detecting sensor 220 receives, with the light-receiving section 220*b*, light which is reflected strongly from the transfer sheet 100 and light which is reflected weakly from conveyance guide plate 186 that is made black to suppress light reflection. Sensor outputs obtained by the light-receiving section 220*b* are compared with a threshold value established in advance, and an edge position of the transfer sheet is detected by discriminating an area outside the transfer sheet where only sensor output lower than the threshold value is obtained. Thus, an image is formed at an appropriate position of the photosensitive drum, after correcting a position of an image to be transferred onto the transfer sheet in the main scanning direction by adjusting it according to the aforesaid detected position. Owing to this, an image is formed and transferred at an appropriate position constantly, despite a positional slip of the transfer sheet in the main scanning direction. In the meantime, it is necessary to receive reflected light having sufficient quantity of light from the transfer sheet, to improve the precision of the aforesaid discrimination.

To achieve the foregoing, it is effective to increase an amount of light emission at the light-emitting section. However, in that case, an amount of reflected light coming from the conveyance guide plate is also increased, and the precision of the discrimination is rather lowered. Therefore, there is generally employed a method to improve the discrimination control through appropriate control of an amount of emitted light by controlling light emitting period for the light-emitting section.

Incidentally, in a market of the shortrun printing, a wide variety of transfer sheets are used, and demands of printing for colored sheets are high. However, if the edge position of the transfer sheet is detected by the aforesaid edge detection sensor, the reflectance varies greatly depending on a color of the transfer sheet, and a sufficient amount of reflected light exceeding the threshold value can not be obtained depending on the color of a sheet, in some cases. For this problem, it is considered to establish the threshold value to be low, in which, however, an error grows greater to create an occasion where an edge position cannot be detected accurately.

The present invention has been achieved under the background of the aforesaid circumstances, and its objective is to provide an image forming apparatus wherein excellent edge detecting accuracy can be obtained, without depending on the color of the transfer sheet.

SUMMARY

An image forming apparatus reflecting one aspect of the invention, comprises: an image forming section to form an image on a transfer sheet conveyed to the image forming section; an edge detecting sensor which detects an edge position of the transfer sheet in a main scanning direction while the transfer sheet is conveyed to the image forming section; and a controller which controls an image writing position at the image forming section based on a result of an edge position detection by the edge detecting sensor; wherein the edge detecting sensor comprises a plurality of light sources each having a different wavelength, and the controller comprises a light source controller which controls lighting of the plural light sources.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENTS

Embodiment 1

The First Embodiment of the invention will be explained as follows, referring to the attached drawings.

Figure 1:
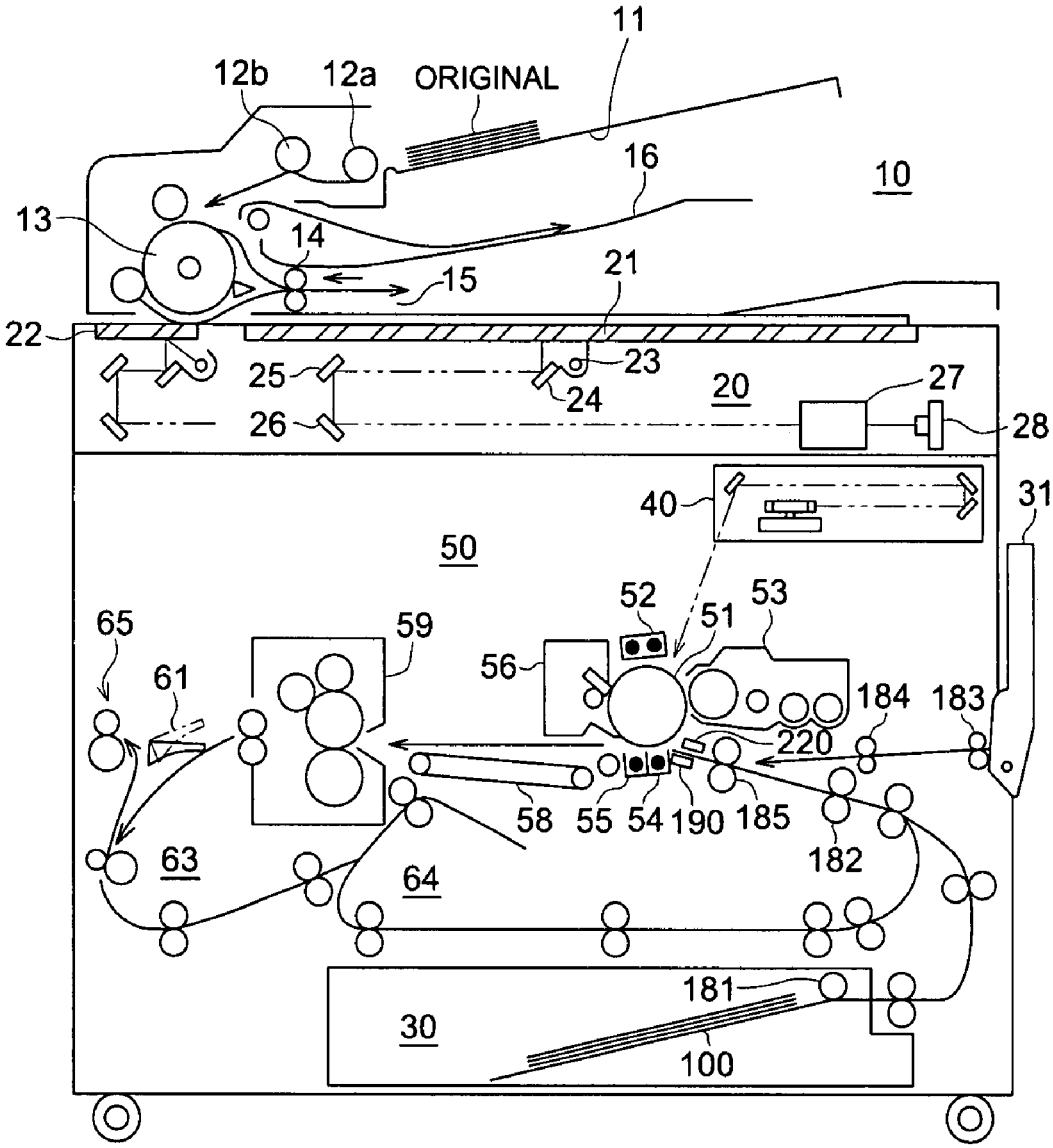
FIG. 1 is a schematic diagram showing a mechanical structure of an image forming apparatus in the First Embodiment of the invention.

FIG. 1 is a schematic diagram showing a mechanical structure of an image forming apparatus in the present embodiment of the invention, and the mechanical structure of the total image forming apparatus will be explained below, referring to FIG. 1.

In the present embodiment, an explanation will be given by using a copying machine as an image forming apparatus.

The image forming apparatus is equipped, on its top portion, with ADF 10 capable of feeding both sides of an original, and an original is placed on original placing section 11 of the ADF 10. Originals on original placing section 11 are fed out in regular order one after another through roller 12*a* and roller 12*b*, to be conveyed on image reading section 20 through roller 13.

The image reading section 20 is provided with light source 23 that illuminates the surface of an original conveyed, and its reflected light is caused to form an image on a light-receiving surface of CCD 28 representing a photoelectric converting section, through mirrors 24, and 26 and through image forming optical system 27. In this case, the image reading section 20 is composed of an optical system having therein light source 23, mirrors 24, 25 and 26, image forming optical system 27 and CCD 28 and of an unillustrated optical system drive section.

Incidentally, when an original is placed on platen glass 21, with its surface to be read facing downward, the optical system scans along the platen glass 21 for reading. Further, when an original is fed automatically to rotate around a circumference of roller 13, reading is conducted under the condition that light source 23 and mirror 24 are fixed under the second platen glass 22. Then, image data of the original, which has been read, are sent to image processing section 210 shown in FIG. 2 from CCD 28.

In the meantime, when a two-sided original is fed automatically by ADF 10, after one original is read as in the foregoing, take-up operations using roller 13 again are conducted through reversing roller 14, thus, an image on the reverse side of the original is read by image reading section 20 in the same way as in the foregoing, and image data thus obtained through reading are sent to image processing section 120. An original, on which an image on its front face only has been read or images on its front and back faces have been read, is stacked on ejection tray 16.

Image data taken through reading by the image reading section 20 are compressed and stored in an unillustrated image memory, after being subjected to prescribed image processing by image processing section 120.

Further, the image forming apparatus has a sheet supply section where transfer sheets are stacked, and from sheet feeding cassette 30 representing one of sheet feeding sections, transfer sheet 100 is fed out by conveyance rollers 181 and 182 to be conveyed, and sent to image forming section 50. Also from manual bypass tray 31 representing one of sheet feeding sections equally, a transfer sheet is fed out by conveyance rollers 183 and 184 when desired, to be conveyed and sent to image forming section 50.

Figure 11:
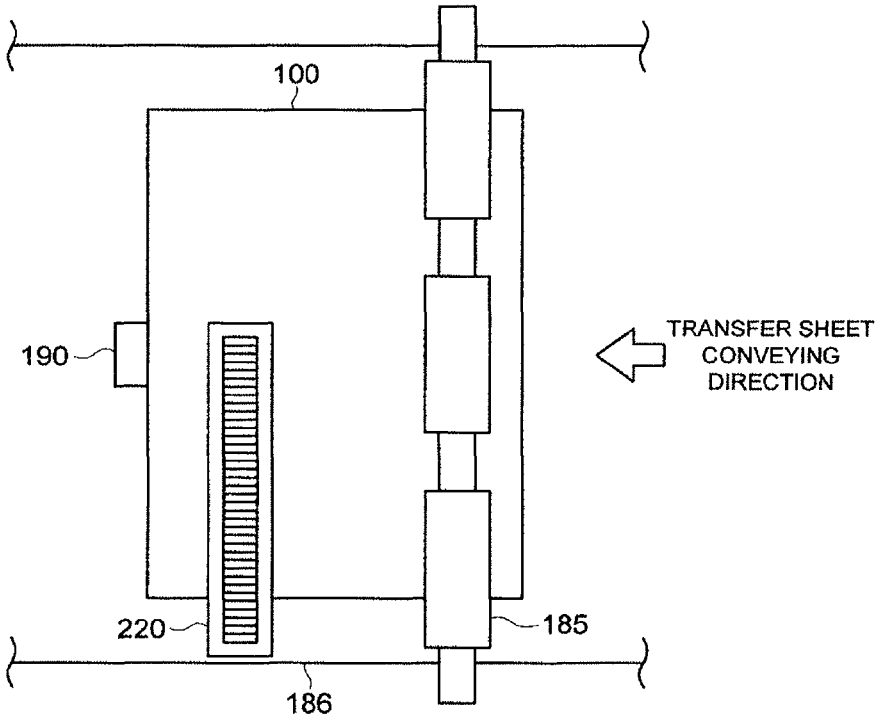
FIG. 11 (a) PRIOR ART
FIG. 11 is a partially enlarged diagram showing the vicinity of arrangement of the edge detection sensor in an image forming apparatus.
Figure 11:
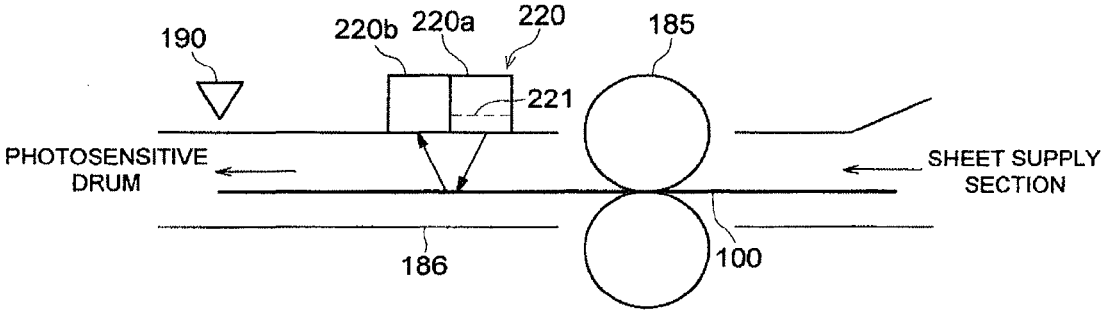
FIG. 11 (b) PRIOR ART

Transfer sheet 100 sent to the image forming section 50 moves on conveyance table 186 shown in FIG. 11(*b*) to approach photosensitive drum 51, after being synchronized by registration roller 185 in the vicinity of an entrance of the image forming section 50.

Figure 2:
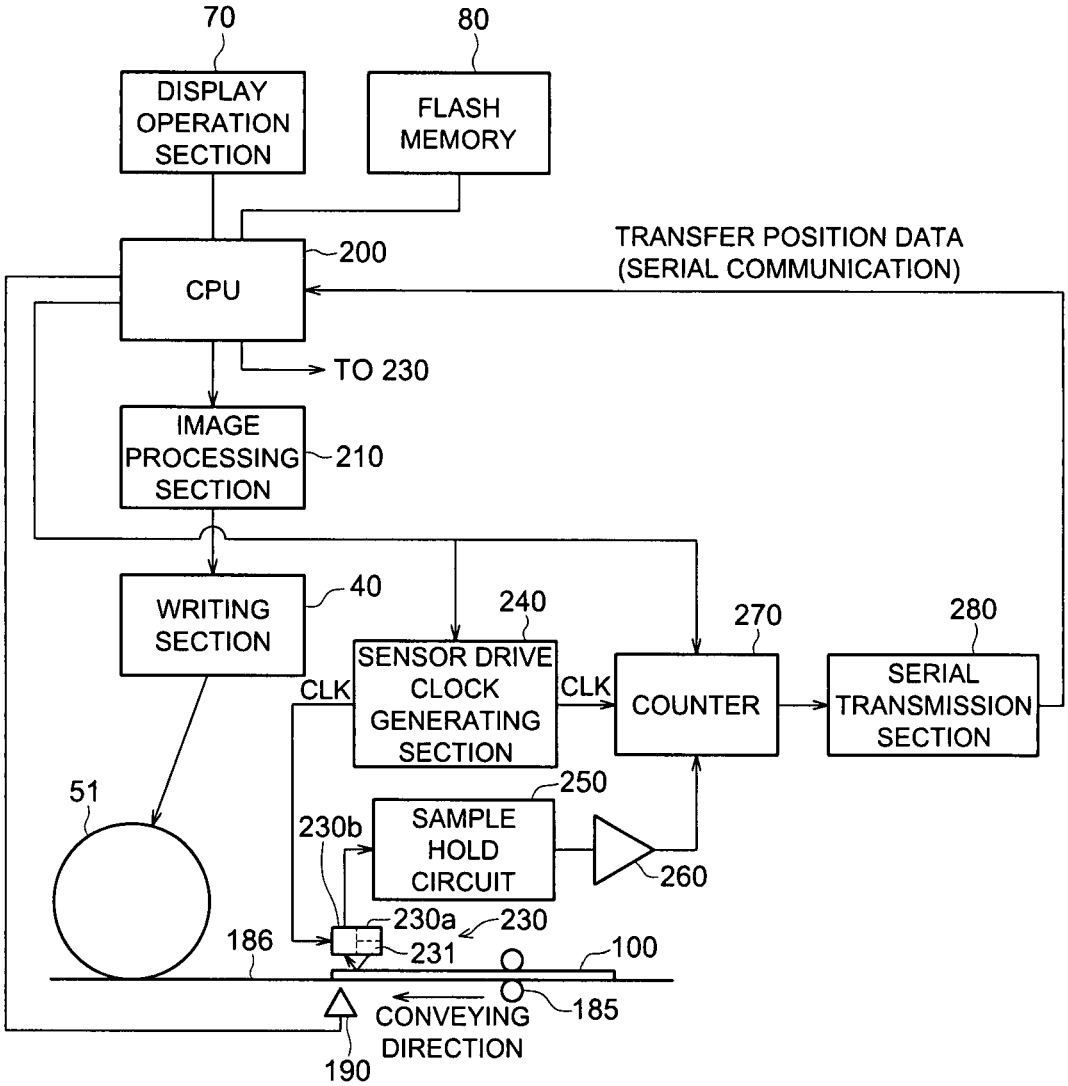
FIG. 2 is a block diagram showing functions on the light-receiving side in a section conducting edge detection in an embodiment of the invention.

Meanwhile, with respect to the transfer sheet 100 synchronized by registration roller 185, its leading edge is detected by leading edge detecting sensor 190, and its passing position in the main scanning direction is detected by edge detecting sensor 230 composed of close contact type line sensors. Incidentally, the edge detecting sensor 230 is arranged between registration roller 185 and leading edge detecting sensor 190 as shown in FIG. 2

Figure 3:
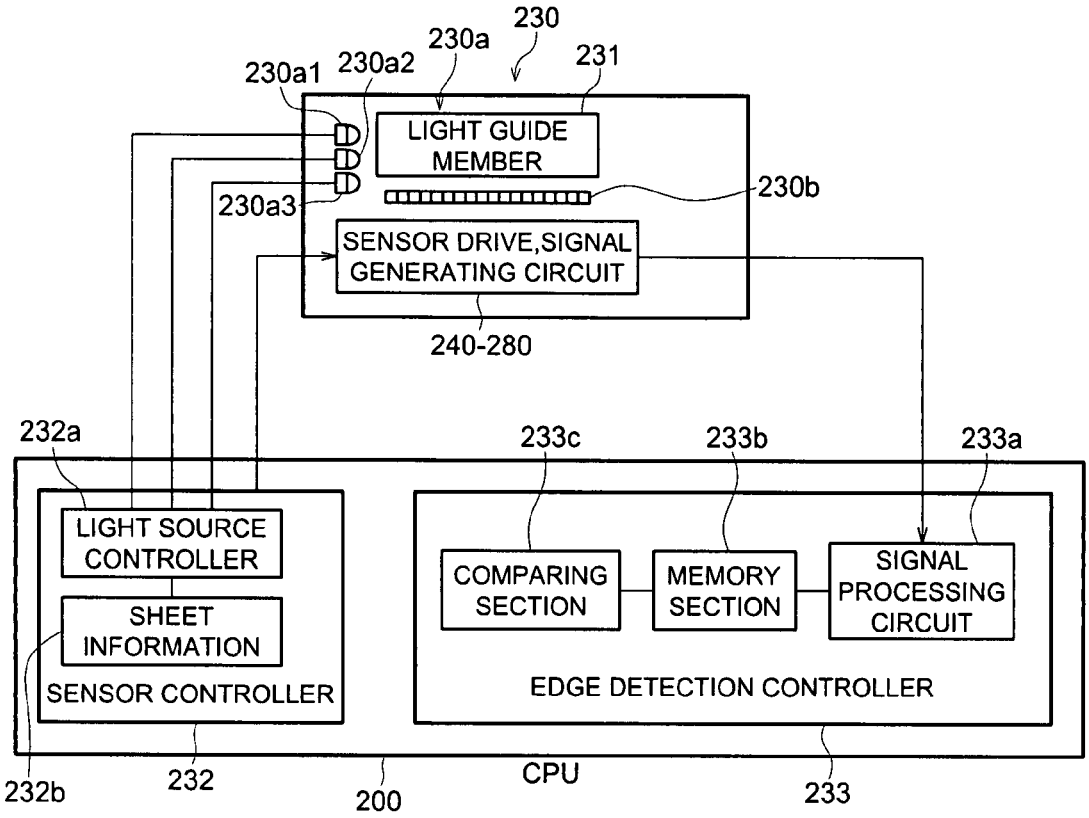
FIG. 3 is a block diagram showing functions on the light-emitting side in a section conducting edge detection in an embodiment of the invention.

The edge detecting sensor 230 is equipped with light-emitting section 230*a* composed of plural light sources 230*a*1-230*a*3 each having a different wavelength, and light guide member 231, as shown in FIG. 3. As the aforesaid light sources, blue LED, red LED and green LED are used as an example. Further, the edge detecting sensor 230 is equipped with light-receiving section 230*b* composed of a line sensor, and the light-receiving section 230*b* receives light that is emitted from light-emitting section 230*a* and is reflected by transfer sheet 100 or by conveyance table 186.

In the image forming apparatus 50, image data are inputted in image writing section 40 from image processing section 210, and photosensitive drum 51 is irradiated with a laser beam corresponding to image data emitted from a laser diode in the in image writing section 40, and an electrostatic latent image is formed. By developing this electrostatic latent image at developing section 53, a toner image is formed on the photosensitive drum 51. The toner image is transferred onto transfer sheet 100 by transfer section 54 located below the photosensitive drum 51. Then, the transfer sheet 100 adhering to the photosensitive drum 51 is separated by separating section 55, to be sent to fixing section 59 through conveyance mechanism 58, thus the toner image on the transfer sheet is fixed by heat and pressure to become a formed image. By the way, when it is necessary to conduct reversing and re-feeding of the sheet for two-sided image forming, the transfer sheet 100 on which the toner image is fixed is conveyed to reversing section 63 located at the lower part through guide 61, then is sent to image reforming section 50 through reversing conveyance path 64 so that an image may be formed on the reverse side. On the photosensitive drum 51 from which an image has been transferred to the transfer sheet, adhering toner is removed by cleaning section 56, to be ready for succeeding image forming.

Further, the transfer sheet 100 which has been finished in terms of image forming in the aforesaid way is ejected to the outside of the apparatus through sheet ejection roller 65.

In the course of the aforesaid image forming, an edge position of the transfer sheet in transit toward image forming section 50 is detected by the edge detecting sensor, and a position of image writing on the photosensitive drum is corrected based on results of the detection. A measure for conducting the correction will be explained by using a block diagram shown in FIG. 2.

CPU 200 controls various sections of the image forming apparatus, and has a function as a controller for controlling detection of a position of passage of the transfer sheet and determination of a position of writing. To the CPU 200, there is connected display operation section 70 which is constituted with LCD provided on the upper part of the image forming apparatus, and is controlled by CPU 200 to be capable of inputting operations for displaying and establishing of information. Further, the CPU 200 is connected with flash memory 80 that can store various types of establishment information such as transfer sheet information, and the CPU 200 can read out these pieces of information suitably.

The CPU 200 is further connected with the image processing section 210 in which the image data are processed, and as one of the foregoing, there is conducted control to correct a writing position in the main scanning direction by receiving information of the writing position determined by the CPU 200. After receiving the result of the correction by the image processing section 210, image writing on photosensitive drum 51 with a laser beam is carried out by writing section 40.

To the CPU 200, there is connected sensor drive clock generating section 240 that generates sensor drive clock for driving light-receiving section 230*b* of edge detecting sensor 230. Further, to the light-receiving section 230*b*, there is connected sample-hold circuit 250 that samples and holds sensor output in synchronization with a sensor drive clock, and comparator 260 that compares the results of holding with a prescribed value (transfer sheet detection level) is connected to the sample-hold circuit 250. Drive clocks of the sensor drive clock generating section 240 are outputted also to counter 270, and the counter 270 counts sensor drive clocks in the case where outputs of comparator 260 are in the prescribed state. To the counter 270, there is connected serial transmitting section 280 that converts the results of the counting into the prescribed serial data, and transfers them to the CPU 200 through serial communication. A sensor drive and signal generating circuit is composed of the sensor drive clock generating section 240, the sample-hold circuit 250, the comparator 260, counter 270 and the serial transmitting section 280, and this circuit is included in the structure of the edge detecting sensor 230.

In the edge detecting sensor 230, light-emitting section 230*a* is controlled by CPU 200. This function will be explained by the use of the block diagram shown in FIG. 3.

The CPU 200 has a function as sensor control section 232 that controls the edge detecting sensor 230, and the sensor control section 232 has a function to issue a command to the sensor drive and signal generating circuit that controls light-receiving section 230*b* as mentioned above, and is further provided with light source control section 232*a* that controls light-emitting section 230*a* of the edge detecting sensor 230, and it properly reads out and holds sheet information 232*b* inputted by the aforesaid display operation section 70 and stored in flash memory 80. As the sheet information, a sheet size, a sheet type, basic weight and color are included as information.

Further, the CPU 200 has a function as edge detection controller 233 that receives sensor output of the edge detecting sensor 230. The edge detection controller 233 is equipped with signal processing circuit 233*a* that receives sensor output and conducts signal processing for preparing data, memory section 233*b* where sensor output data are stored and are read out, and comparing section 233*c* that compares sensor output data. Incidentally, the memory section 233*b* may be composed of the flash memory 80, RAMs inside and outside the CPU 200, other flash memories and HDD.

Next, operations of an image forming apparatus with the aforesaid structure will be explained.

Figure 4:
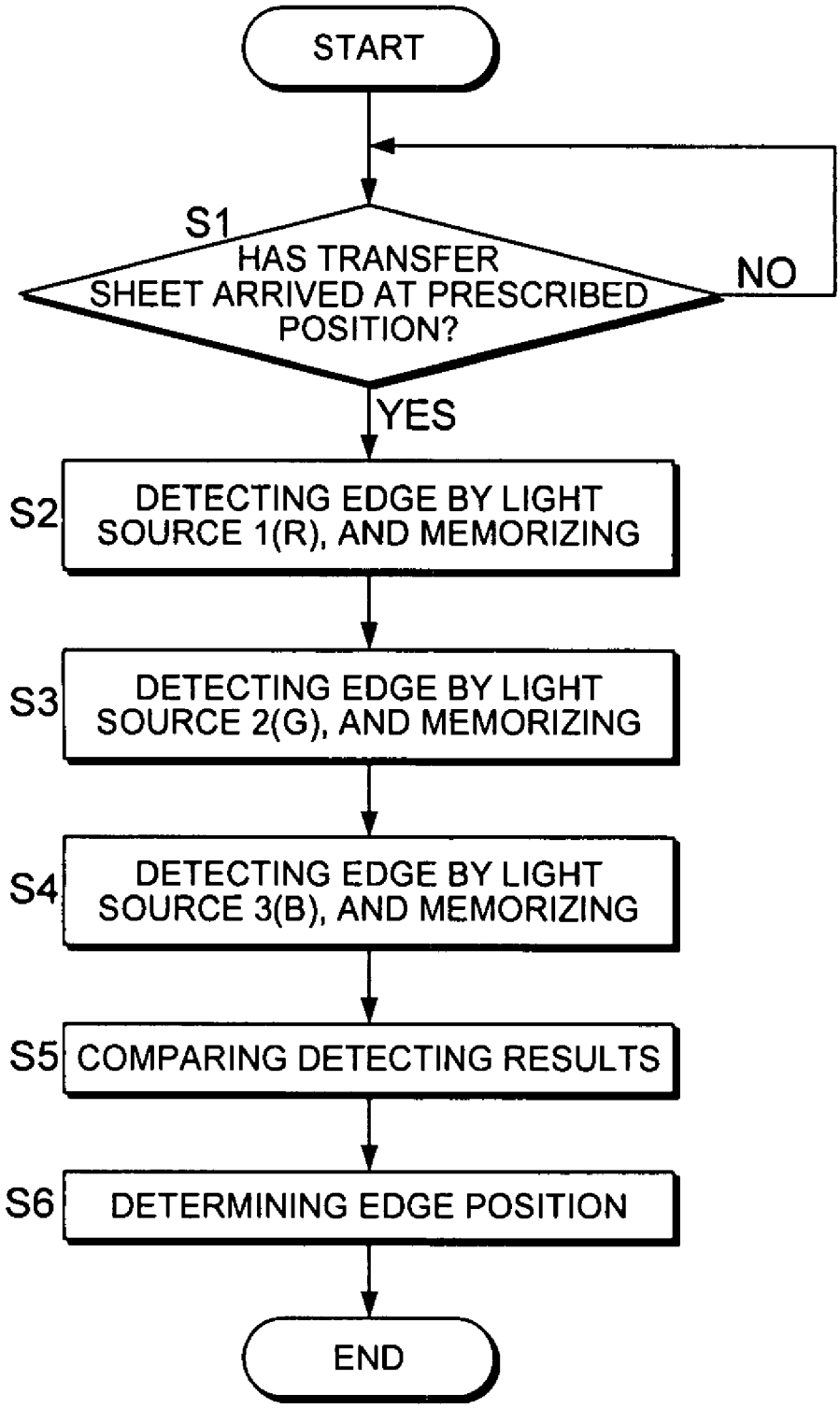
FIG. 4 is a flow chart showing an example of procedures for edge detection employing an edge detecting sensor in an embodiment of the invention.

Image data are obtained through reading of original by the image reading section 20, and when printing is started, image data are sent to image processing section 210. On the other hand, transfer sheet 100 is fed out of sheet supply cassette 30 or of manual bypass tray 31 to be conveyed, and it is synchronized by registration roller 185, and is conveyed to the downstream side on conveyance table 186. Incidentally, edge position detecting processing for the transfer sheet is also started with conveyance of the transfer sheet. This processing routine will be explained based on the flow chart shown in FIG. 4.

In the routine, transfer sheet 100 is detected whether it has arrived at a prescribed position or not. In this example, leading edge detecting sensor 190 judges whether the transfer sheet has arrived at a prescribed position or not. The result of the detection by the leading edge detecting sensor 190 is given to CPU 200 (step S1). Based on this information, the light source is lit by light source controller 232*a* in sensor controller 232. Meanwhile, the present explanation will be given under the assumption that plural light sources (232*a*1-232*a*3) are lit sequentially for edge position detection of a single transfer sheet in this processing procedure. In the flow chart shown in FIG. 4, by the way, light sources 232*a*1-232*a*3 are shown respectively by red light source 1 (R), green light source 2 (G) and blue light source 3 (B).

When color information of the transfer sheet is not obtained, the sequential lighting of light sources may be established automatically by CPU, or it may be established by an operator by selecting from the sequential lighting and lighting of a single light source, by operating on display operation section 70. The present explanation is given under the assumption that color information of the transfer sheet is not present and the sequential lighting has been selected automatically.

In the sequential lighting of light sources, light source 1 (R) is lit first, then, sensor drive clock is given to light-receiving section 230*b* by a sensor drive and signal generating circuit, and sensor output is obtained. This output is stored in memory section 233*b* (step S2) after being processed in terms of signals by signal processing circuit 233*a*. Then, for the same transfer sheet, light source 2 (G) is lit after light source 1 (R) is turned off, and sensor output is obtained by a sensor drive and signal generating circuit from the light-receiving section 230*b* in the same way as in the foregoing. This output is also stored in memory section 233*b* (step S3) after being processed in terms of signals by signal processing circuit 233*a*. Further, for the same transfer sheet, light source 3 (R) is lit after light source 2 (G) is turned off, and sensor output is obtained by a sensor drive and signal generating circuit from the light-receiving section 230*b*. This sensor output is also stored in memory section 233*b* (step S4) after being processed in terms of signals by signal processing circuit 233*a*.

After sensor outputs respectively obtained through three light sources are stored in memory section 233*b*, these sensor outputs are compared by comparing section 233*c* (step S5). In the case of this comparison, respective sensor outputs may also be compared directly in terms of value size, or it is also possible to obtain a difference (margin) between a reference value (threshold value) established based on each light source color and a sensor output, and to compare an amount of margin in terms of size. It is possible to calculate an amount of margin by reading out the reference value (threshold value) based on a light source color emitted, by storing reference value (threshold value) data correlated with each light source color in flash memory 80 in advance After the aforesaid comparison, the maximum sensor output or the sensor output of the maximum margin is determined to be the edge position detecting sensor output. Based on this sensor output, an edge position of the transfer sheet is determined (step S6) in edge detection controller 233. Incidentally, an edge position based on the sensor output can be determined by the known method. After the edge position detecting processing is completed in the foregoing, the results of the detection is given to image processing section 210, and a position of writing on photosensitive drum 51 is corrected depending on the result of the detection in the image processing section 210. Correction data are given to writing section 40, and writing on photosensitive drum 51 is conducted at an appropriated position well-fitting to the position of the transfer sheet in the main scanning direction, and image forming on the transfer sheet is properly conducted based on the aforesaid writing.

In the present embodiment, it is possible to obtain sensor output which is great enough by a light source well-fitting to the color of a transfer sheet, by controlling selection and switching of light sources with a light source controller, because an edge detecting sensor has a plurality of light sources each having a different wavelength, thus, an edge position of the transfer sheet can be detected highly accurately, independently of a color of the transfer sheet.

A light source has only to be one capable of emitting light with an intended wavelength, and it is not limited to the specific light source. However, an LED is suitable on the point of responsiveness or the like.

Incidentally, the number of light sources is not limited in particular, if it is two or more, and a wavelength of each light source is not limited to the specific wavelength. For example, respective light sources respectively having various wavelengths offering excellent sensor outputs for respective colors are prepared, by assuming various colors of transfer sheets used for image forming.

Table 1 below shows an example of relationship between a color of a transfer sheet and a wavelength (color) of a preferable light source fitting to the color of the transfer sheet.

TABLE 1

| Transfer sheet color | Light source color |
|---|---|
| Pink | Red |
| Orange | Red |
| Yellow | Green or Red |
| Green | Green |
| Blue | Yellow |

Incidentally, in the edge detection sensor, a light-receiving section that receives light emitted from the light source is provided, and as the light-receiving section, a line sensor employing a light-receiving element can be used.

A light source controller has only to be one capable of controlling selection and switching of light sources, and it can be composed of a part of a sensor controller composed of an analog circuit having a switching function, CPU and a program operating the CPU and of a part of an apparatus controller.

In the present embodiment, even when a color of the transfer sheet is unknown, it is possible to obtain sensor output by a light source with a wavelength unsuitable for the color of a transfer sheet and sensor output by a light source with a wavelength suitable for the color of a transfer sheet, by switching light sources each having a different wavelength in regular order and by lighting for a single transfer sheet. Out of these sensor outputs, when using a light source with a wavelength suitable for the color of a transfer sheet, a sensor output greater than other sensor outputs is obtained, and by selecting this sensor output for the edge detection, a precision of edge detection for the transfer sheet can be enhanced.

Further, the present embodiment makes it possible to store plural sensor outputs obtained by switching and lighting sequentially respective light sources into a memory section, then to compare each sensor output by a comparing section and to determine the optimum sensor output used for edge detection. In the comparing section, greatest sensor output or the sensor output having the greatest amount of margin can be determined to be the sensor output for edge position detection through sensor output mutual comparison in terms of size and through margin amount comparison in terms of size for the reference value for each color light source established in advance.

Incidentally, the aforesaid memory section is one capable of storing data properly such as RAM, a flash memory and HDD, and it is not limited to the specific one in the invention. The comparing section is one conducting comparison and determining processing based on data read out from the memory section, and it can be composed of CPU and a program for operating CPU.

Embodiment 2

Figure 5:
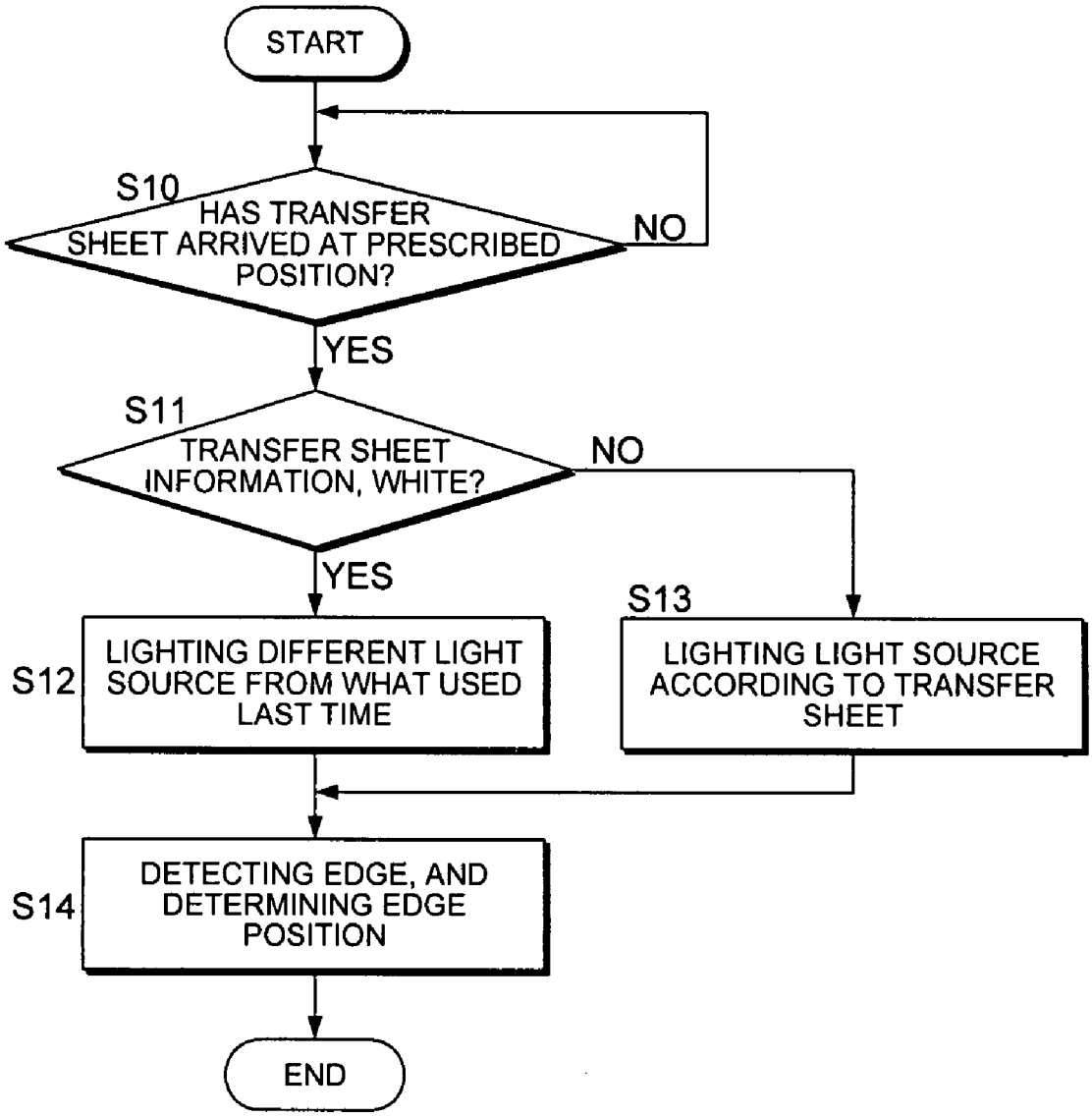
FIG. 5 is a flow chart showing another example of procedures for edge detection employing an edge detecting sensor in an embodiment of the invention.

Though the case where plural light sources are lit sequentially independently of a transfer sheet color was explained in the aforesaid Embodiment 1, there will be explained, in the Embodiment 2, the procedures to conduct edge processing by selecting a light source to be used based on the color information under the assumption that the color information of the transfer sheet has been obtained, referring to the flow chart shown in FIG. 5. In the meantime, an explanation of the mechanical structures of the image forming apparatus will be omitted because they are the same as those in the Embodiment 1.

In the present embodiment, transfer sheet information including at least color information of the transfer sheet is obtained in advance. This transfer sheet information is inputted by a transfer sheet information inputting section, and in the present embodiment, the aforesaid display operation section 70 functions as a transfer sheet information inputting section.

Figure 7:
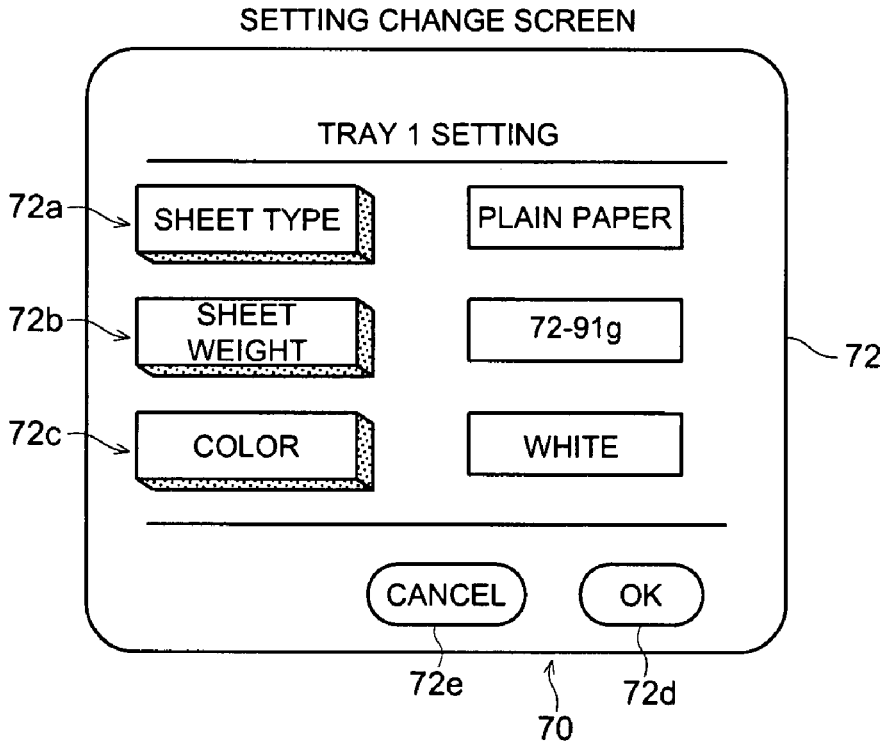
FIG. 7 is a diagram showing another operation screen in a transfer sheet information inputting section in an embodiment of the invention.
Figure 8:
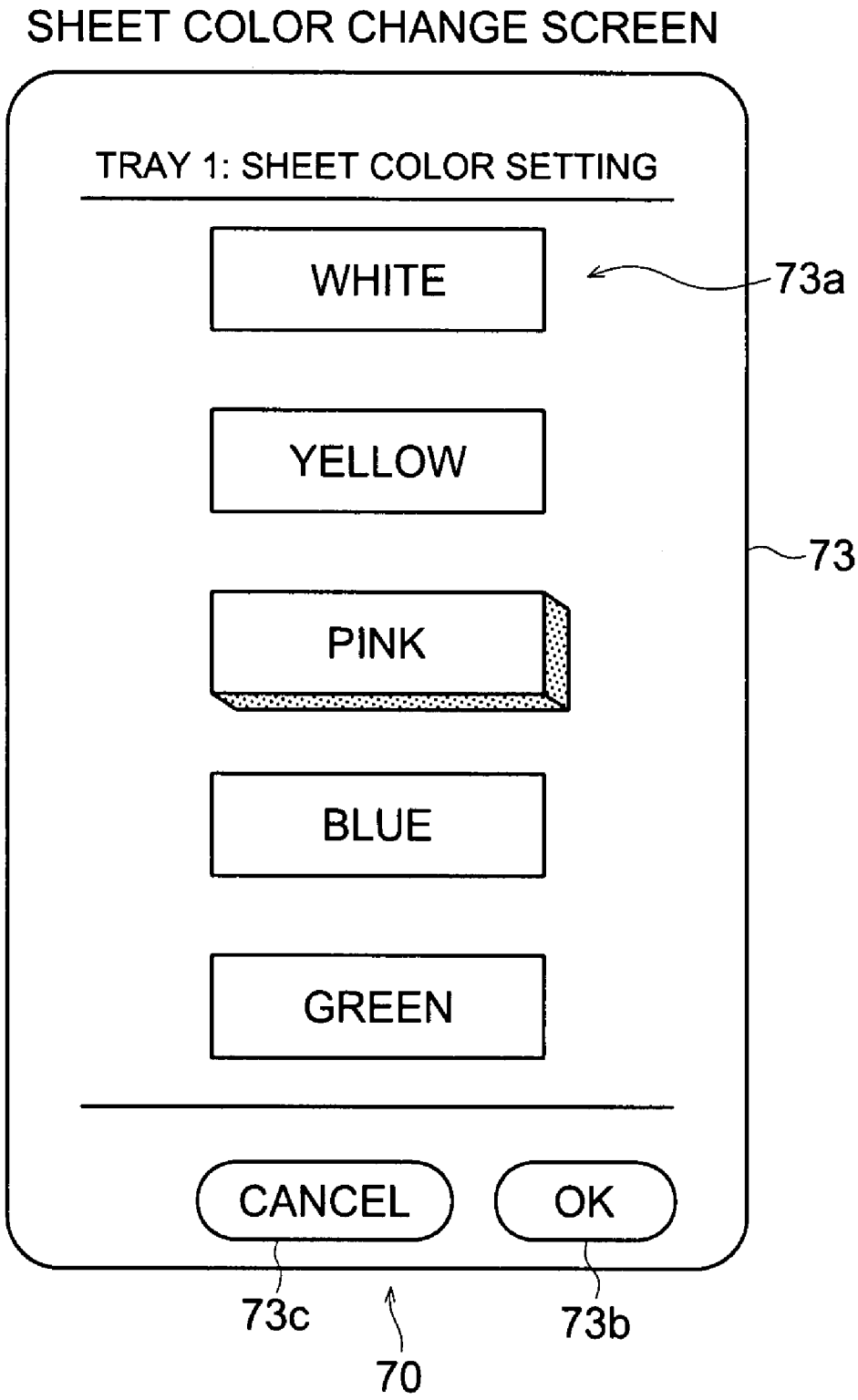
FIG. 8 is a diagram showing still another operation screen in a transfer sheet information inputting section in an embodiment of the invention.

First, prior to the aforesaid processing routine, a section to input transfer sheet information will be explained, referring to FIG. 6-FIG. 8.

Figure 6:
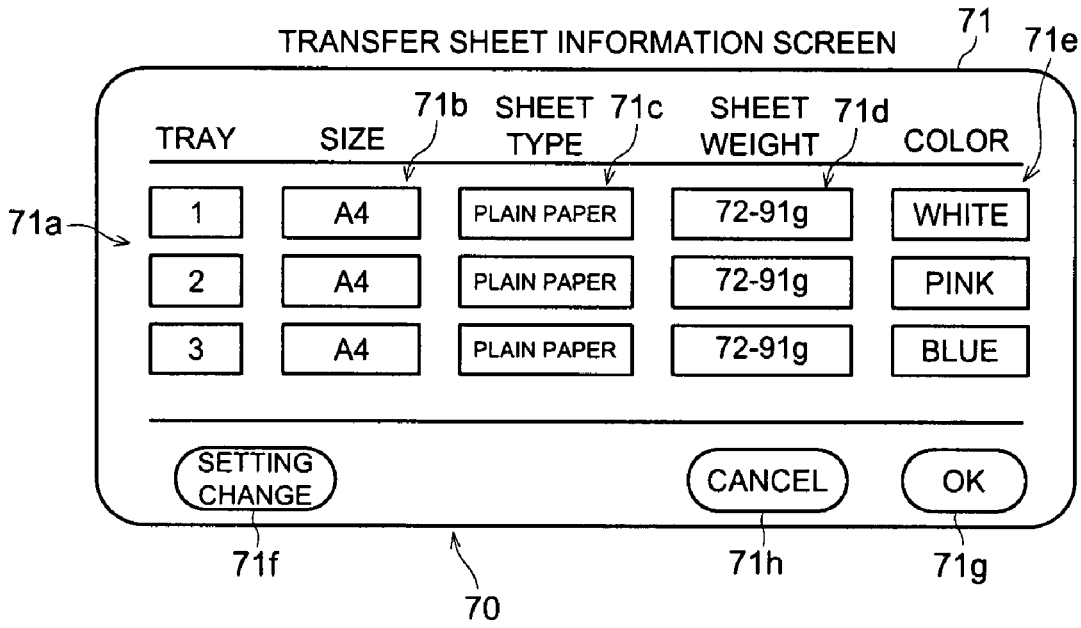
FIG. 6 is a diagram showing a certain operation screen in a transfer sheet information inputting section in an embodiment of the invention.

As shown in FIG. 6, it is possible to display transfer sheet information screen 71 by selecting a menu on the operation screen, on display operation section 70. The transfer sheet information screen 71 has thereon tray display section 71*a* that classifies and displays each tray, sheet size display section 71*b* that shows a sheet size corresponding to the tray, sheet type display section 71*c* that shows a sheet type, sheet weight display section 71*d* that shows a sheet weight and color display section 71*e* that shows a sheet color, and it further has setting change button 71*f*, Ok button 71*g* and cancel button 71*h*. After a tray in the tray display section 71*a* is selected, when the setting change button 71*f* is pushed, it can change transfer sheet information displayed on each display section. The OK button 71*g* is a button to decide the changed transfer sheet information and to store it on a flash memory as transfer sheet information, while, the cancel button 71*h* is a button to cancel the changed transfer sheet information. After the Ok button 71*g* or the cancel button 71*h* is pushed, the display operation section 70 restores the transfer sheet information screen to the setting screen that shows a condition before the selection.

Next, an occasion where tray 1 is selected and the setting change button 71*f* is pushed, will be explained. When this button is pushed, a display on the display operation section 70 is changed, setting change screen 72 shown in FIG. 7 is displayed. This screen has thereon sheet type display and setting section 72*a*, sheet weight display and setting section 72*b* and color display and setting section 72*c*. On each display and setting section, there is displayed transfer sheet information which has been set. Further, the setting change screen 72 has OK button 72*d* and cancel button 72*e*, and when the OK button 72*d* is pushed, changed setting is maintained, and is restored on the aforesaid transfer sheet information screen 71. In this case, on the transfer sheet information screen 71, changed setting is displayed, and setting change is kept to be in the undecided state until the moment when the OK button 71*g* is pushed. When the cancel button 72*e* on the setting change screen 72, changed setting is canceled, and the screen is restore to the transfer sheet information screen 71.

If the desired display and changing section is pushed on the setting change screen 72, setting of the transfer sheet information can be changed. When color display and setting section 72*c* is pushed in this case, sheet color changing screen 73 shown in FIG. 8 is displayed on the display operation section 70. This screen has a plurality of color setting buttons 73*a* which can set colors. This screen further has OK button 73*b* and cancel button 73*c*. When the OK button 73*b* is pushed after changing the sheet color, the screen is restored to the aforesaid setting change screen 72, while the changed sheet color information is maintained. On the other hand, when the cancel button 73*c* is pushed, the changed sheet color information is canceled, and the screen is restored to the setting change screen 72.

The transfer sheet information, which has been set in the foregoing, is stored in flash memory 80 by CPU 200, and is read out properly by CPU 200.

When image forming is started under the state where transfer sheet information including color information has been obtained through the foregoing, a tray for sheet feeding is determined, and transfer sheet information including color information is acquired by CPU 200 based on the determined tray. Procedures of edge position detecting processing will be explained as follows, referring to the flow chart shown in FIG. 5.

In the same way as in the Embodiment 1, it is detected that the transfer sheet has arrived at the prescribed position (step S10) when the transfer sheet is detected by a leading edge detecting sensor. Then, it is judged whether the transfer sheet to be fed out is white or not (step S11), based on the aforesaid transfer sheet information. When the transfer sheet is white in this case, a single light source, which is different from the light source used in white sheet JOB for the preceding white transfer sheet, is selected (step S12). In this connection, color information of the transfer sheet in at least the preceding JOB and information of the light source having been used are preserved in a nonvolatile memory section such as flash memory 80 or HDD, for example, and are read out of the memory section in the course of the aforesaid processing to be used for the aforesaid judgment. Further, data of the order of light sources to be changed for each JOB in white sheet job are determined in advance to be stored in the memory section such as the aforesaid nonvolatile flash memory 80, whereby, a light source following the preceding light source used previously can be selected based on the aforesaid data of the order.

When the transfer sheet in the present JOB is not white, a light source having the color fitted to the color of the transfer sheet is selected based on the color of the transfer sheet (step S13). Incidentally, for selection of a light source, the relationship between a color of a transfer sheet and a light source having a color that is fitted to the color of the transfer sheet is stored in the memory section such as nonvolatile flash memory 80, and data of the appropriate color of a light source corresponding to the color of the sheet are acquired from the memory section in the course of the aforesaid processing, thus, a single light source to be used is selected based on the aforesaid data.

After a single light source to be used has been determined in the aforesaid way, sensor output by the light source is obtained, and an edge position of the transfer sheet is detected based on the sensor output (step S14). Corrected writing on the photosensitive drum is conducted in the same way as in the Embodiment 1. In the present embodiment, wasteful electric power caused by lighting of plural light sources is not consumed because a single light source only is used. Further, in the case of white sheet job, it is possible to avoid that a specific light source is used disproportionately, by changing the single light source to be used.

In the aforesaid embodiments, explanations have been given under the assumption that an edge position of a transfer sheet is detected for the total range of light-receiving section 230*b* representing a line sensor in the main scanning direction. However, there are some occasions wherein a transfer sheet to be subjected to image forming has thereon preliminary printing, and in this case, there is the possibility that black preliminary printing causes an error in edge detection. To avoid this, a range of expected edges is established based on a transfer sheet size in advance (for example, expected edge based on a sheet size±10 mm), and the aforesaid detection of the edge position is conducted only for the range of expected edges, thus, erroneous detection can be avoided. In this connection, an area of the expected edges is established as data correlated with each sheet size, and this is stored in a memory section composed of nonvolatile flash memory 80. Hereby, transfer sheet size information can be acquired from transfer sheet information obtained from image forming, and data of the range of expected edges stored in the aforesaid memory section can be read out based on the transfer sheet size.

In the present embodiment, it is possible to detect an edge position of the transfer sheet accurately by using a light source suitable for the color of the transfer sheet selected from plural light sources each having a different wavelength. With respect to the selection of a light source, it is possible to select based on color information of a transfer sheet, or an operator can select an appropriate light source.

In the present embodiment, it is possible to select a light source having a color which is best suited to the transfer sheet and allows to obtain large sensor output, by utilizing information of transfer sheet colors inputted by a transfer sheet information inputting section, and thereby, to conduct detection of edge position of the transfer sheet accurately.

In the present embodiment, when conducting image forming on a white transfer sheet that allows to obtain a proper amount of sensor output even when using a light source having any wavelength, it is possible, by switching a single light source to be used for each JOB, to lengthen a life of the total light source by avoiding that a specific light source is used on a one-sided basis. Incidentally, it is possible to judge whether a transfer sheet to be subjected to image forming is white or not, based on information of transfer sheet color inputted by the aforesaid transfer sheet information inputting section. Further, even when transfer sheet color information is not available, it is also possible to handle in the same way as white sheet job by presuming that the transfer sheet is white.

Further, in the present embodiment, an edge position can be detected accurately without an error, because detection of the edge position is conducted at the vicinity of the edge position of the transfer sheet estimated in advance. For example, an edge detection can be conducted even for the transfer sheet which has been subjected to preliminary printing and is partially different in terms of a color.

Further, in the present embodiment, an estimated range of an edge position is immediately established based on a transfer sheet size, by referring to the aforesaid memory section. The transfer sheet size can be acquired easily based on transfer sheet information.

With respect to each of a memory section for storing information of transfer sheet colors and a light source having been used in the aforesaid preceding white sheet job, a memory section for storing color information of a transfer sheet and a suitable color of a light source by correlating them each other, a memory section for storing data of the order for light sources to be used in white sheet job, and a memory section for storing a size of a transfer sheet and an estimated range of edge positions by correlating them each other, a part of the memory section or the whole of the memory section can be constituted with an integral memory section, or each memory section can also be constituted with separate ones.

In the aforesaid embodiments 1 and 2, explanations have been given for the occasion for lighting plural light sources in regular order and the occasion for lighting the selected one light source, for the detection of edge position of a single transfer sheet. In the present invention, it is also possible to switch a light method on the half way of a job, in addition to continuing these lighting operations.

Figure 9:
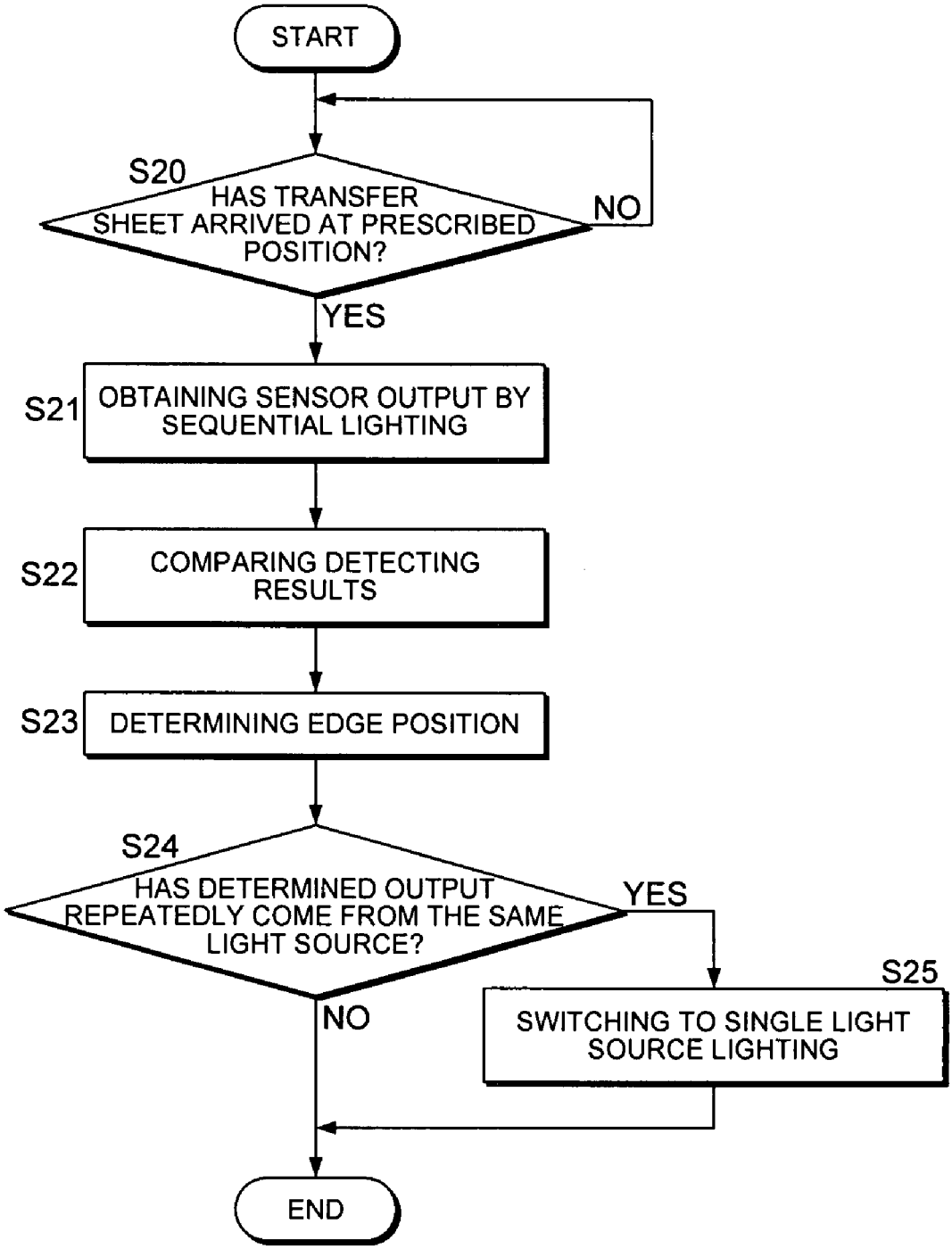
FIG. 9 is a flow chart showing an example of changes in procedures for edge detection employing an edge detecting sensor in an embodiment of the invention.

Namely, FIG. 9 shows procedures to conduct lighting in regular order and to detect an edge position (step S20-S23). In this case, when sensor output to be selected is one related to the specific light source continuously (step S24), it is possible to omit lighting of other light sources and to switch (step S25) so that the aforesaid specific light source may be used individually to be lit. In this connection, a length of continuation for switching can be set properly, and it is possible to set and store the number of times of repetition in flash memory 80 by the initial setting, and to conduct the aforesaid switching when the repetition exceeds this number of times of the repetition.

In the above embodiment, when the sensor output determined from plural sensor outputs is one related to the specific light source continuously, it is possible to use only a light source having a single color, by estimating that transfer sheets having a color to which a color of the light source is suitable are conveyed continuously. Owing to this, processing to compare and determine by obtaining plural sensor outputs turns out to be unnecessary, enhancing processing efficiency, and lighting of plural light sources turns out to be unnecessary, resulting in saving of power consumption and improvement of durability of a light source.

Figure 10:
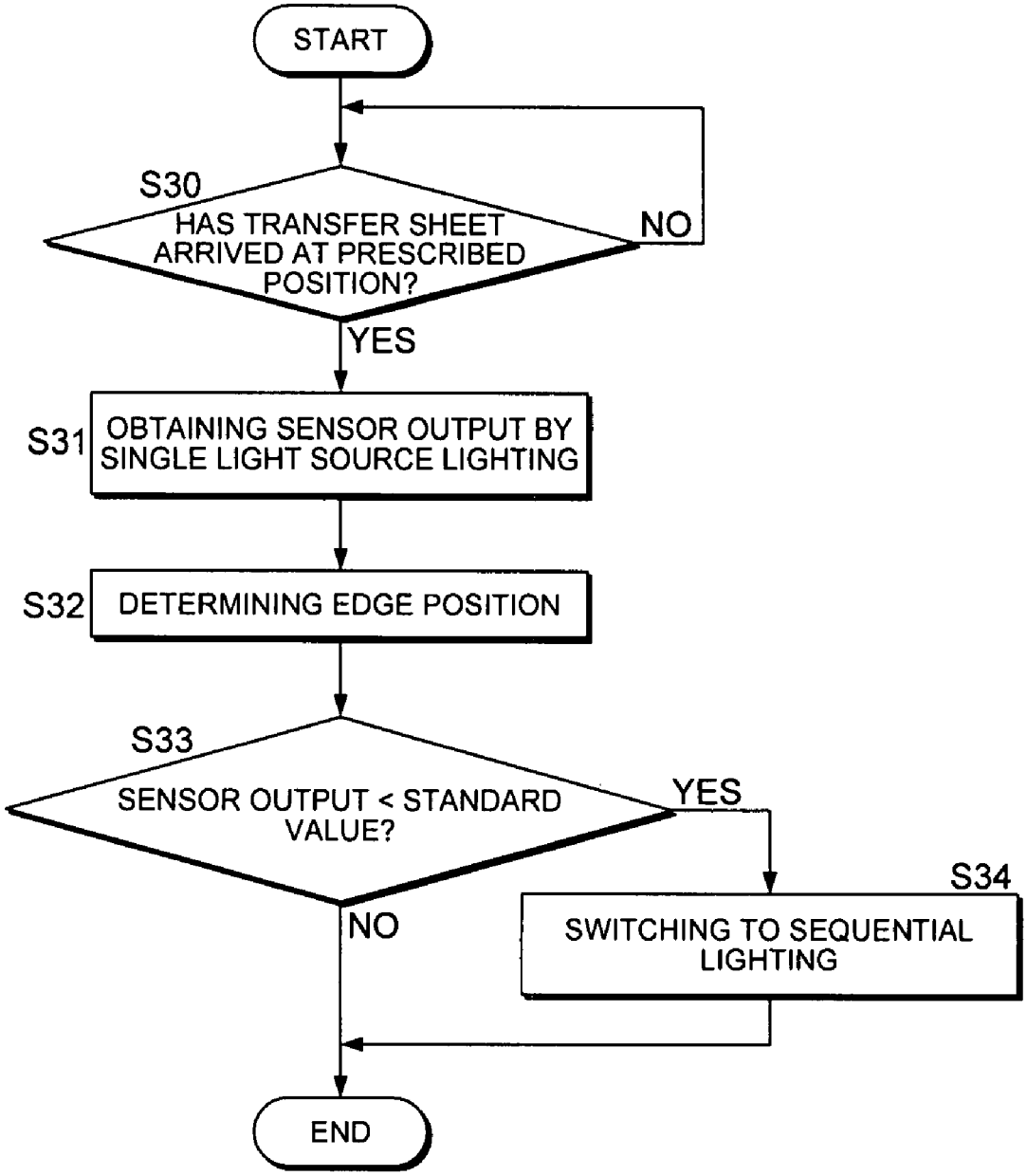
FIG. 10 is a flow chart showing further an example of changes in procedures for edge detection employing an edge detecting sensor in an embodiment of the invention.

Next, FIG. 10 shows procedures to detect edge positions by lighting a single light source based on a sheet color (steps S30-32). In this case, when the sensor output does not reach the prescribed value (step S33), the procedure is switched to detection of edge position by sequential lighting (step S34) because there is the possibility that a color of the light source is not fitted to the color of the transfer sheet. Incidentally, the prescribed value is established in advance as the lowest value of sensor output with which the detection accuracy of the edge position can be obtained, to be stored in flash memory 80 representing a nonvolatile memory, and it is read out through the aforesaid processing to be used for judgment.

In the above embodiment, when sensor output that is large enough is not obtained in the course of conducting edge detection for a transfer sheet by using a single light source, since transfer sheet information is erroneous or a color of the light source is not fitted to the color of a transfer sheet, it is possible to obtain a proper amount of sensor output that is fitted to the color of a transfer sheet, by lighting light sources each having a different wavelength equipped on an edge detection sensor.

Though explanations of the present invention have been given based on each embodiment above, the invention is not limited to contents of the aforesaid explanations, and the disclosed embodiments can naturally be varied by a skilled person without departing from the spirit and scope of the invention.

As explained above, the image forming apparatus of the invention in which an edge position of the transfer sheet in transit in the main scanning direction is detected by an edge detecting sensor, and an image writing position on the image forming section is controlled based on the results of the detection, in the case of conducting image forming by conveying the transfer sheet to the image forming section, provided is an edge detecting sensor having plural light sources each having a different wavelength and a light source controller that controls lighting of the aforesaid plural light sources, thus, sensor output that is large enough in terms of amount can be obtained by a proper light source regardless of the color of the transfer sheet, and an edge position of the transfer sheet can be detected accurately.

What is claimed is:

1. An image forming apparatus comprising:

an image forming section which forms an image on a transfer sheet conveyed to the image forming section;

an edge detecting sensor which detects an edge position of the transfer sheet in a main scanning direction while the transfer sheet is conveyed to the image forming section; and a controller which controls an image writing position at the image forming section based on a result of an edge position detection by the edge detecting sensor;

wherein the edge detecting sensor comprises a plurality of light sources each having a different wavelength, and the controller comprises a light source controller which controls lighting of the plural light sources, wherein the light source controller sequentially switches to light each of the plurality of light sources while the edge detecting sensor detects the edge position of a single transfer sheet, wherein the image forming apparatus further comprises:

a memory section which stores each of sensor outputs obtained by the edge detecting sensor when each of the plurality of light sources each having a different wavelength is lit; and a comparing section which compares the sensor outputs stored in the memory section, and based on a result of comparison, determines a sensor output, among the sensor outputs respectively obtained when each of the plurality of light sources is lit, to be used for determining the edge position of the transfer sheet.

2. The image forming apparatus of claim 1, wherein when the sensor output for determining the edge position of the transfer sheet, determined based on the result of comparison, continuously corresponds to a specific light source among the plurality of light sources, the light source controller controls to selectively light the specific light source as a single light source.

3. The image forming apparatus of claim 2, further comprising:

a transfer sheet information inputting section to input transfer sheet information including color information of the transfer sheet;

wherein based on the color information of the transfer sheet inputted by the transfer sheet information inputting section, the light source controller controls to selectively light a single light source, among the plurality of light sources, to detect the edge position of the transfer sheet.

4. The image forming apparatus of claim 3, wherein the memory section further stores the color information of the transfer sheet correlated with information of proper light source color.

5. The image forming apparatus of claim 2, wherein in cases where a white transfer sheet is used for image formation, the light source controller controls to selectively light a single light source which is different in wavelength from a light source having been used for a previous white color job to use the white transfer sheet.

6. The image forming apparatus of claim 5, wherein the memory section further stores color information of the transfer sheet and information of light source, both the information corresponding to the previous white color job executed at least last time.

7. The image forming apparatus of claim 5, wherein the memory section further stores data of order with which each of the plurality of light sources is to be used for the white color job.

8. The image forming apparatus of claim 2, wherein when the sensor output does not reach a prescribed value, the light source controller controls to sequentially switch lighting the plurality of light sources to detect an edge position of a next transfer sheet.

9. The image forming apparatus of claim 1, wherein when the sensor output does not reach a prescribed value, the light source controller controls to sequentially switch lighting the plurality of light sources to detect an edge position of a next transfer sheet.

10. The image forming apparatus of claim 3, wherein when the sensor output does not reach a prescribed value, the light source controller controls to sequentially switch lighting the plurality of light sources to detect an edge position of a next transfer sheet.

11. The image forming apparatus of claim 1, wherein a range of expected edge position in the main scanning direction is predetermined based on size information of the transfer sheet, and the edge detecting sensor detects the edge position of the transfer sheet in the main scanning direction within the range of expected edge position.

12. The image forming apparatus of claim 2, wherein a range of expected edge position in the main scanning direction is predetermined based on size information of the transfer sheet, and the edge detecting sensor detects the edge position of the transfer sheet in the main scanning direction within the range of expected edge position.

13. The image forming apparatus of claim 1, wherein a range of expected edge position in the main scanning direction is predetermined based on size information of the transfer sheet, and the edge detecting sensor detects the edge position of the transfer sheet in the main scanning direction within the range of expected edge position.

14. The image forming apparatus of claim 3, wherein a range of expected edge position in the main scanning direction is predetermined based on size information of the transfer sheet, and the edge detecting sensor detects the edge position of the transfer sheet in the main scanning direction within the range of expected edge position.

15. The image forming apparatus of claim 11, further comprising a memory section which stores data of the range of expected edge position by correlating with the size information of the transfer sheet.

* * * * *